United States Patent [19]

Pomares et al.

[11] 4,284,472

[45] Aug. 18, 1981

[54] METHOD FOR ENHANCED CONTROL OF RADIOIODINE IN THE PRODUCTION OF FISSION PRODUCT MOLYBDENUM 99

[75] Inventors: Raul J. Pomares, Livermore; Carl P. Ruiz; Douglas H. Simpson, both of Fremont, all of Calif.

[73] Assignee: General Electric Company, San Jose, Calif.

[21] Appl. No.: 951,651

[22] Filed: Oct. 16, 1978

[51] Int. Cl.[3] ..... G21G 1/06

[52] U.S. Cl. ..... 176/16; 252/301.1 R; 423/249

[58] Field of Search ..... 176/10, 14, 16; 252/301.1 R; 423/249

[56] References Cited

U.S. PATENT DOCUMENTS

| | | | |
|---|---|---|---|
| Re. 29,066 | 12/1976 | Evans | 252/361.1 R |
| 2,710,249 | 6/1955 | Winsche et al. | 423/249 |
| 2,795,482 | 6/1957 | McNabney | 423/249 |
| 3,018,159 | 1/1962 | Silverman | 423/249 |
| 3,148,941 | 9/1964 | Gens . | |
| 3,282,655 | 11/1966 | Case et al. | 423/249 |
| 3,429,655 | 2/1969 | Case et al. | 423/249 |
| 3,745,119 | 7/1973 | Arino et al. | 252/301.1 R |
| 3,752,769 | 8/1973 | Lewis et al. | 252/301.1 R |
| 3,971,697 | 7/1976 | Blue | 176/16 |
| 4,094,953 | 6/1978 | Hadi et al. | 423/2 |

FOREIGN PATENT DOCUMENTS 2349804 4/1975 Fed. Rep. of Germany .

OTHER PUBLICATIONS

Int. J. of Applied Radiation & Isotopes, vol. 22, pp. 603–605, 1971.

Chem. Abs., vol. 84, No. 36595w, (1976).

IAEA Tech. Reports Series No. 169, "A Review of Methods for the Determination of I-131 in the Marine Environment", Dutton, 1975.

Int. J. of Applied Rad. & Isotopes, vol. 26, pp. 107–118, 1975, McLain Jr.

Int. J. of Applied Rad. & Isotopes, vol. 28, pp. 485–489, 5/77, Motojima et al.

ANL-6577, 7/62, Studier et al., pp. 1–10.

ORNL-3840, 1/66, Case et al., pp. 1–5.

*Primary Examiner*—Harvey E. Behrend

*Attorney, Agent, or Firm*—Ivor J. James, Jr.; Raymond G. Simkins; Samuel E. Turner

[57] ABSTRACT

A method is disclosed for controlling the release of radioiodine produced by the fission of uranium 235 during the process for the production of molybdenum 99. In the process for producing molybdenum 99, an aluminum-uranium alloyed target is irradiated with a neutron flux to bring about fission of the Uranium 235 producing molybdenum 99, radioiodine and other fission by-products. The method herein comprises reacting the irradiated target with a caustic solution. A reactive silver is then mixed with the caustic solution in an amount sufficient to react with substantially all of the radioiodine present in the caustic solution thereupon forming a silver precipitate of radioiodine. The precipitate formed is then separated from the caustic solution resulting in a substantially radioiodine-free caustic solution containing molybdenum 99.

12 Claims, No Drawings

METHOD FOR ENHANCED CONTROL OF RADIOIODINE IN THE PRODUCTION OF FISSION PRODUCT MOLYBDENUM 99

BACKGROUND OF THE INVENTION

This invention relates to a method for controlling the release of the radioiodine produced during the process for the production of molybdenum 99 by fission of uranium 235 ($U^{235}$).

Molybdenum 99 ($Mo^{99}$) is useful as an isotope generator of six-hour technetium 99 m which is a widely used radioisotope in diagnostic medicine. Molybdenum 99, having a high specific activity and being radio chemically pure, is conveniently prepared from the fission of $U^{235}$. The $U^{235}$ fission is brought about by neutron irradiation producing among the isotopes those of molybdenum and iodine. Other fission by-products, such as zirconium, niobium and ruthenium can also be present. The specific activity of the fission products depends upon the irradiation time, neutron flux of irradiation and the decay period following reactive discharge.

Briefly, molybdenum 99 is produced by irradiating an aluminum-uranium alloy in a neutron flux of about $2\times10^{14}$ neutrons per square centimeter per second ($n/cm^2sec$). Generally, following irradiation for an extended period of time, the aluminum-uranium alloyed target is allowed to decay for a short period of time, such as eight hours following reactor discharge, to reduce the amount of short-lived fission products.

The target is reacted in strong caustic, such as sodium hydroxide to release fission-product gases. The resultant solution is filtered to remove uranium and insoluble fission by-product hydroxides. Following filtration, the filtrate is acidified with a strong acid such as sulfuric acid. The acid is added to volatilize any radioiodine produced during the fission process. Various radioiodine isotopes are produced during the fission of $U^{235}$. The longer half-life isotopes formed are $I^{131}$, $I^{132}$, $I^{133}$ and $I^{135}$. The acidic residue is extracted with bis(2-ethylhexyl)phosphoric acid to extract $Mo^{99}$. The ensuing organic and aqueous phases are separated and the organic phase is washed with hydrochloric acid. The hydrochloric acid wash is used to remove aluminum, rare earths and alkaline earth fission products that can be present in small amounts as well as entrained aqueous feed solution. In addition, iodine 131–135, zirconium 95, niobium 95 and ruthenium 103–106 are partially extracted from the organic phase by the hydrochloric acid solution.

The free radioiodine liberated from the process solution by acidification is volatilized and collected in a scrubbing process wherein the scrubbing solution is a solution of sodium hydroxide and sodium sulfite. As iodine is highly volatile, charcoal filters are generally positioned along the flow path of the process to absorb any radioiodine not removed by the scrubbing process.

The procedure practiced in the state-of-the-art process for removing radioiodine presents problems due to the volatile nature of the radioiodine. Special precautions must be taken to prevent the release of the volatile radioiodine into the atmosphere. Care must also be taken in the handling of the waste material from the scrubber process as such waste material contains radioactive material. This scrubber waste material also presents a handling and disposal problem in that it is a relatively large volume in relation to the volume of the caustic solution used to react with the aluminum-uranium alloy target.

SUMMARY OF THE INVENTION

The present invention provides a method for controlling the release of radioiodine produced during the production of molybdenum 99 by the fission of $U^{235}$. In the process for producing $Mo^{99}$ an aluminum-uranium alloyed target is irradiated with neutrons to bring about fission of the uranium and production of $Mo^{99}$, radioiodine and other fission by-products. The target is then reacted with a caustic solution. In the practice of the method for controlling the release of the radioiodine, reactive silver which is reactive with radioiodine is mixed with the caustic stream containing dissolved aluminum-uranium target material $Mo^{99}$, radioiodine and other fission by-products. A reactive silver can be a silver which is in a state such that the silver is free to react and is capable of reacting with the radioiodine. Suitable reactive silver includes silver salts such as silver sulfate and silver nitrate. The reactive silver is generally added as a solution. The reactive silver is introduced into the caustic solution in an amount sufficient to react with substantially all of the radioiodine present in the solution. Generally, the reactive silver is added in an amount which is about a two to one stoichiometric ratio of silver to caustic solution constituents which have an affinity for silver. The reactive silver is thoroughly mixed with the caustic solution. As the reactive silver is mixed, the radioiodine present in the caustic solution reacts with the silver forming a precipitate, which is insoluble in the caustic solution. The precipitate formed is removed from the caustic solution by means sufficient for removing solids from liquids in which the solids are entrained. Suitable means includes filtration such as a sintered metal filter. When a filter is employed to remove the silver precipitate containing the radioiodine from the caustic solution, the filtration is aided by the presence of undissolved uranium in the caustic solution, which undissolved uranium acts as a filter aid. Following collection of the silver precipitate upon the filter, the filter is sealed and the precipitate which contains the radioiodine is removed from the system in the filter and thereby effectively controlled.

The reactive silver can also be incorporated within the filter matrix. In this manner, the radioiodine present in the caustic solution can contact the reactive silver while the caustic solution is being filtered to remove entrained solids such as solid fission by-products and insoluble target material. Incorporating reactive silver within the filter matrix in combination with adding reactive silver to the caustic solution enhances control of radioiodine as radioiodine remaining unreacted with the reactive silver at the time of filtering can react with the reactive silver within the filter matrix to form a precipitate.

Controlling radioiodine released during the production of $Mo^{99}$ by forming a silver precipitate provides an effective method of preventing loss of radioiodine to the environment through volatilization. The silver precipitate formed provides an easily handleable solid material which can be removed from the process. Further, the solid silver precipitate of radioiodine removed is present in a volume substantially less than the liquid volumes present in the state-of-the-art radioiodine recovery processes using liquid-liquid scrubbing techniques. This method herein also accomplishes control of the radioiodine in a time period substantially less than the time period needed to control radioiodine in the state-of-the-art radioiodine control processes using liquid-liquid scrubbing techniques. The method provides further control of radioiodine in that the precipitated radioiodine is substantially nonreactive and, therefore, the precipitated radioiodine passing through the filter with the caustic solution does not tend to volatilize nor interfere with the subsequent recovery steps of $Mo^{99}$ from the caustic solution.

DETAILED DESCRIPTION OF THE INVENTION

The method herein relates to the control of radioiodine produced as a fission product during the production of molybdenum 99.

An aluminum-uranium alloyed target is irradiated with a neutron flux sufficient to bring about fission of the uranium. The fission product of principal interest from the neutron bombardment is molybdenum 99. Other fission products include radioiodine, zirconium 95, niobium 95 and ruthenium 103–106. The term radioiodine is used herein to refer to all of the radioactive isotopes of iodine produced during fission of $U^{235}$ and primarily including the longer half-lived radioisotopes of $I^{131}$, $I^{132}$, $I^{133}$ and $I^{135}$. Various other short-lived radioisotopes are also produced, but because of their short half-lives and rapid decay they present no appreciable problem in regard to contamination of molybdenum 99 product or in regard to disposal.

The method herein described relates to the control of the radioiodine fission product. Such radioiodine, primarily comprising: $I^{131}$ having a half-life of 8.06 days and decaying primarily by negative beta emission of about 0.60 million electron volts (MeV) and gamma emission of about 0.364 MeV; $I^{132}$ having a half-life of 2.29 hours and decaying by negative beta emission of 0.80, 1.04, 1.61, 2.14 MeV and gamma emission of 0.673 and 0.78 MeV; $I^{133}$ having a half-life of 21 hours and decaying by negative beta emission of 1.22 MeV and gamma emission of 0.53 MeV; and $I^{135}$ having a half-life of 6.7 hours and decaying through negative beta emission of 1.0, 1.4, 0.5 MeV and gamma emission of 0.14–2.0 MeV. As radioiodine has radioisotopes of relatively long half-life, it is necessary to remove the radioiodine to prepare a radiochemically pure molybdenum 99 product. Many problems are presented in the removal of the radioiodine. As iodine is highly volatile, it is readily lost to the surrounding atmosphere which can cause a radioactive environmental contamination problem.

The radioiodine produced by the fission of uranium and therefore present in the system should be controlled to prevent escape of the radioiodine and to prevent radiochemical contamination of the environment. The word "control" as used herein, in regard to controlling the radioiodine, is used in a broad sense to include treating the radioiodine in such a manner that the radioiodine loses its propensity to volatilize and thereby radioiodine produced by fission of uranium is substantially retained within the system. Thus, the radioiodine can be removed from the system without any appreciable loss.

The aluminum-uranium alloyed target is reacted with a strong caustic solution such as sodium hydroxide. Upon completion of the reaction of the aluminum-uranium target in the caustic solution, a reactive silver is added to the caustic solution. Reactive silver is any silver which is capable of reacting with the radioiodine present to form a precipitate. Suitable reactive silver can be silver salts such as silver sulfate and silver nitrate. Silver nitrate is a preferred form of reactive silver as it is readily soluble and the nitrate ion formed upon dissolution does not interfere with subsequent process steps in the recovery of molybdenum 99. Although reactive silver can be provided by a variety of silver salts, it is preferred to utilize a salt which has a low toxicity. Using a silver salt of relatively low toxicity prevents the occurrence of hazardous conditions which can arise as a result of using a reagent of high toxicity.

In the preferred practice of this method of controlling radioiodine, the reactive silver is dissolved in a suitable solvent, such as water, and then the silver solution is added to the caustic solution. It is preferred to add the reactive silver in solution form to the caustic solution to allow the greatest probability and opportunity for a silver ion to interact with an iodine ion. Although it is preferred to add the reactive silver in solution to the caustic solution, the reactive silver can also be used in a less soluble form. When the reactive silver is used in such a less soluble form, it can be incorporated into the filter bed as part of the filter matrix. Upon filtering the caustic solution to remove solids, the radioiodine present in the caustic solution can interact with the reactive silver forming a precipitate which is retained by the filter.

The reactive silver added to the caustic solution is added in an amount sufficient to react with substantially all of the radioiodine present in the caustic solution and other constituents which have an affinity for silver. Generally, such a sufficient amount is an excess of the amount necessary to be stoichiometric with the radioiodine present. It is preferred, since other constituents in the caustic solution can have an affinity for the reactive silver, that the reactive silver be added in an amount which is in excess of the amount required to be stoichiometric with all of the solution constituents which have an affinity for silver. An excess of reactive silver, which is twice the amount needed to be stoichiometric with the solution constituents having an affinity for silver, is preferred. Such a two-fold excess is preferred to cover uncertainties in the determination of the solution constituents present. A greater amount of reactive silver can be added but generally does not provide any significantly greater recovery of radioiodine. An amount of reactive silver less than the preferred two to one stoichiometric ratio can be used if more precise determination of the concentration of the solution constituents having an affinity for silver is made.

Adding the reactive silver to the caustic solution following dissolving the aluminum-uranium target provides little opportunity for the radioiodine present to volatilize. As little opportunity for volatilization is provided, no appreciable quantity of radioiodine volatilizes to contaminate the air within the $Mo^{99}$ recovery system. The radioiodine substantially is captivated and retained as a solid precipitate of silver.

Following the addition of the reactive silver to the caustic solution containing the dissolved aluminum-uranium target $Mo^{99}$, radioiodine, and uranium fission by-products, the solution is thoroughly mixed and filtered. The mixture is filtered to remove undissolved target material, insoluble fission by-products and the precipitated silver iodide. Any insoluble uranium and insoluble fission by-products enhance the filtration process as the insoluble material acts as a filter aid. As stated above, the filter matrix can contain reactive silver to form the precipitate with radioiodine. Providing reactive silver in the filter matrix can be used alone or in combination with providing reactive silver in solution form to the caustic solution.

The separation of the precipitated radioiodine from the caustic solution can be enhanced by adding an iodine carrier to the caustic solution prior to adding the reactive silver. Suitable iodine carriers which can be added can be any soluble iodine salt which provides free iodine ions in the caustic solution. The addition of an iodine carrier, such as potassium iodide, to the caustic solution results in larger silver iodide particles being formed which enables good retention of the silver iodide particles on the filter.

Other techniques for separating solids from liquids in which they are entrained can be used other than filtration if desired. Such other techniques which can be used are centrifugation, entrainment separators, settling and decantation, which techniques are known in the art.

The following example illustrates the operability of this method when used to control radioiodine produced during the fission of $U^{235}$ in the preparation of $Mo^{99}$. This example is meant to illustrate the utility of the method and is not meant to limit the scope of the method.

EXAMPLE

An aluminum-uranium target was prepared from 16 g of $U^{235}$ and 87 g of aluminum. The target was formed into a hollow cylinder. The target was irradiated for 8.6 hours in a neutron flux of about $1\times10^{14}$ n/cm$^2$sec. Following irradiation, the target was allowed to decay for about 6 hours to reduce the amount of short-lived fission products.

The target was then reacted with 2.02 liters of a 5 N NaOH solution. After the completion of the reaction of the target with the NaOH solution, an aqueous silver sulfate solution was added to the caustic solution. The aqueous silver sulfate solution was made by dissolving 300 mg of $Ag_2SO_4$ in 1.56 liters of water. The entire resultant silver sulfate solution was added to the caustic solution. The silver present in the silver sulfate solution represented about a two-fold stoichiometric ratio of silver to all of the NaOH solution constituents having an affinity for silver.

The resulting mixture was mixed for 15 minutes. Following mixing, the mixture was filtered through a 0.2 micron filter to remove undissolved uranium, insoluble fission by-products and precipitated radioiodine.

Based upon analysis of the fission product yield of $Mo^{99}$ recovered from the filtrate passing through the filter, it was determined that there was about a 98 percent retention of radioiodine on the filter. The radioiodine was removed in an easily handleable solid form with substantially little loss of radioiodine through volatilization.

To illustrate the effectiveness of controlling radioiodine, measurements of radioactivity were taken on the caustic solution prior to and following the filtration step. The following activities measured in millicuries per milliliter were found.

| | Before Filtration | After Filtration |
|---|---|---|
| $I^{131}$ | 75.5 | 1.2 |
| $I^{132}$ | 43.9 | 0.94 |
| $I^{133}$ | 222.0 | 4.3 |
| $I^{135}$ | 55.5 | 1.2 |

The method herein provides control of the radioiodine during the production process for $Mo^{99}$. There is substantially no appreciable loss of radioiodine through volatilization as the free radioiodine present in the system after fission of the $U^{235}$ becomes bound in a silver precipitate which is a substantially stable, solid salt. The silver precipitate formed provides an easily handleable form for the radioiodine and provides less volume of radioactive by-product and material for handling and disposal than the scrubbing processes using sodium sulfite. The silver precipitate also is relatively unreactive and, therefore, any precipitate not collected by the filter and thereby separated from the caustic solution containing $Mo^{99}$ does not deleteriously affect the subsequent processing steps for the recovery of $Mo^{99}$.

Although the process has been described herein with regard to using a reactive silver for controlling the radioiodine another reactive metal, such as palladium, having a strong affinity for iodine, can be utilized to control the radioiodine in a similar manner.

We claim:

1. A method for controlling radioiodine produced by the fission of uranium 235 during the process for the production of molybdenum 99 wherein uranium 235 is alloyed with aluminum forming a target which is irradiated with a neutron flux, for producing molybdenum 99, radioiodine and other fission by-products, the method consisting essentially of the steps of:

(a) dissolving the aluminum-uranium alloyed target containing molybdenum 99, radioiodine and other fission by-products in an aqueous caustic solution;

(b) mixing with the caustic solution an amount of reactive silver sufficient to react with substantially all of the radioiodine present in the solution for forming a silver containing precipitate;

(c) filtering the caustic solution for separating the precipitate, undissolved uranium and insoluble fission by-products from the caustic solution filtrate; and (d) recovering the solids containing the radioiodine in the form of the silver containing precipitate from the filter.

2. A method as recited in claim 1 wherein the reactive silver is a soluble silver salt which is in solution prior to mixing with the caustic solution.

3. A method as recited in claim 2 wherein the soluble silver salt is selected from the group consisting of silver sulfate and silver nitrate.

4. A method as recited in claim 1 wherein the reactive silver is mixed with the caustic solution in a two to one stoichiometric molar ratio of reactive silver to the constituents present in the caustic solution which have an affinity for silver.

5. A method as recited in claim 1 wherein the reactive silver is mixed with the caustic solution in an amount in excess of the stoichiometric molar ratio of silver to radioiodine present in the caustic solution.

6. A method as recited in claim 1 further comprising the step of incorporating reactive silver within the filter matrix for reacting with any unreacted radioiodine present in the caustic solution during the filtering step.

7. A method for controlling radioiodine produced by the fission of uranium 235 during the process for the production of molybdenum 99 wherein uranium 235 is alloyed with aluminum forming a target which is irradiated with a neutron flux for producing molybdenum 99, radioiodine and fission by-products, the method consisting essentially of the steps of:

(a) chemically reacting the aluminum-uranium alloyed target containing molybdenum 99, radioiodine and other fission by-products with an aqueous sodium hydroxide solution;

(b) precipitating the radioiodine present in the caustic solution by adding a reactive metal selected from the group consisting of silver and palladium to the caustic solution in an amount in excess of the stoichiometric molar ratio of metal to radioiodine present in the caustic solution;

(c) separating the precipitate from the sodium hydroxide solution; and (d) recovering molybdenum 99 from the sodium hydroxide solution and removing the precipitate containing the radioiodine.

8. A method as recited in claim 7 wherein the reactive metal is a silver salt selected from silver sulfate and silver nitrate.

9. A method as recited in claim 7 wherein the reactive metal is present in an amount which is about a two to one stoichiometric ratio of the metal to the constituents present in the sodium hydroxide solution having an affinity for the metal.

10. A method for controlling radioiodine produced by the fission of uranium 235 during the process for the production of molybdenum 99 wherein uranium 235 is alloyed with aluminum forming a target which is irradiated with a neutron flux causing fission of the uranium 235 producing molybdenum 99, radioiodine and fission by-products, the method consisting essentially of the steps of:

(a) reacting the aluminum-uranium alloyed target containing molybdenum 99, radioiodine and other fission by-products with an aqueous caustic solution;

(b) incorporating within a filter matrix a reactive silver in an amount sufficient to react with substantially all of the radioiodine present in the caustic solution, and other constituents which have an affinity for the silver;

(c) filtering the caustic solution through the filter containing reactive silver forming a solid silver containing precipitate;

(d) recovering substantially radioiodine-free caustic filtrate containing molybdenum 99; and (e) recovering solid precipitated radioiodine in the filter.

11. A method of producing molybdenum 99 by the fission of uranium 235 alloyed with aluminum and controlling the radioiodine fission by-product thereof, comprising the steps of:

(a) irradiating an aluminum-uranium alloy in a neutron flux to cause fission thereof and thereby produce molybdenum 99;

(b) dissolving the irradiated aluminum-uranium alloy containing molybdenum 99 fission product and radioiodine and other fission by-products in an aqueous caustic solution;

(c) adding to the caustic solution an amount of reactive silver sufficient to react with substantially all of the radioiodine present in the solution for forming a silver containing precipitate with the radioiodine within the caustic solution;

(d) filtering the caustic solution for separating the precipitate containing the silver and radioiodine, undissolved uranium and insoluble fission by-products from the caustic solution filtrate;

(e) recovering the precipitated and filtered out solids containing the radioiodine in the form of the silver containing precipitate from the filter; and, (f) extracting the molybdenum 99 from the solution.

12. A method of producing molybdenum 99 by the fission of uranium 235 alloyed with aluminum and controlling the radioiodine fission by-product thereof, comprising the steps of:

(a) irradiating an aluminum-uranium alloy in a neutron flux to cause fission thereof and thereby producing molybdenum 99;

(b) dissolving the irradiated aluminum-uranium alloy containing molybdenum 99 fission product and radioiodine and other fission by-products in an aqueous solution of sodium hydroxide;

(c) adding to the sodium hydroxide solution an amount of silver compound selected from the group consisting of silver nitrate and silver sulfate providing two to one stoichiometric ratio of reactive silver to the constituents present in the sodium hydroxide solution for forming a silver containing precipitate with the radioiodine within the sodium hydroxide solution;

(d) filtering the sodium hydroxide solution for separating the precipitate containing the silver and radioiodine, undissolved uranium and insoluble fission by-products from the sodium hydroxide solution filtrate;

(e) recovering the precipitated and filtered out solids containing the radioiodine in the form of the silver containing precipitate from the filter; and (f) treating the sodium hydroxide solution filtrate to enable the extraction of the molybdenum 99.

* * * * *